United States Patent [19]

Michassouridis

[11] 4,201,169

[45] May 6, 1980

[54] CONTROL INSTALLATION FOR THE IDLING ROTATIONAL SPEED OF INTERNAL COMBUSTION ENGINES

[75] Inventor: Athanasios Michassouridis, Munich, Fed. Rep. of Germany

[73] Assignee: Bayerische Motoren Werke Aktiengesellschaft, Fed. Rep. of Germany

[21] Appl. No.: 857,892

[22] Filed: Dec. 6, 1977

[30] Foreign Application Priority Data

Dec. 6, 1976 [DE] Fed. Rep. of Germany ..... 2655171

[51] Int. Cl.[2] ..... F02M 69/00

[52] U.S. Cl. ..... 123/124 R; 123/119 D; 123/139 AW

[58] Field of Search ..... 123/124 R, 139 AW, 119 D, 123/119 DB, 97 B

[56] References Cited

U.S. PATENT DOCUMENTS

| | | | |
|---|---|---|---|
| 3,809,035 | 5/1974 | Winton | 123/119 D X |
| 3,901,203 | 8/1975 | Pozniak | 123/119 A |
| 4,064,854 | 12/1977 | Fehrenbach et al. | 123/139 AW |
| 4,103,654 | 8/1978 | Nakamura | 123/119 D |

FOREIGN PATENT DOCUMENTS

| | | | |
|---|---|---|---|
| 2538921 | 3/1977 | Fed. Rep. of Germany | 123/139 AW |

*Primary Examiner*—Wendell E. Burns
*Attorney, Agent, or Firm*—Craig & Antonelli

[57] ABSTRACT

A control installation for the idling rotational speed of internal combustion engines, in which a by-pass control valve is provided that is controlled by an actuating device dependent on the suction pipe pressure and is located in parallel to a throttle valve which can be selectively actuated; the opening cross section of the by-pass valve which increases with increasing suction pipe pressure, thereby increases progressively.

9 Claims, 4 Drawing Figures

CONTROL INSTALLATION FOR THE IDLING ROTATIONAL SPEED OF INTERNAL COMBUSTION ENGINES

The present invention relates to a control installation for the idling rotational speed of internal combustion engines with a by-pass control valve disposed in parallel to a selectively actuatable throttle valve and controlled by an adjusting motor dependent on the suction pipe pressure, whose opening cross section increases with an increasing suction pipe pressure.

Known control installation of this type of construction (German Pat. No. 1,601,392, German Offenlegungsschrift No. 1,804,790 and German Gebrauchsmuster No. 7,039,342) include a by-pass control valve whose opening cross section increases proportionally with the stroke of the valve body. No satisfactory control of the idling rotational speed can be achieved alone with such control installations because the loads of internal combustion engines which also differ strongly during idling with a cold internal combustion engine as also with an internal combustion engine at its normal operating temperature in each case with or without engagement of additional and/or auxiliary aggregates as well as automatic transmissions containing hydraulic couplings or torque converters, cannot be kept within sufficiently small rotational speed limits. Additional by-pass valves controlled as a function of temperature or temperature-dependent adjusting members overriding the by-pass valve controlled in dependence on the suction pipe pressure are therefore always necessary and known in connection therewith (German Pat. No. 1,601,392). The structural expenditure for the idling rotational speed control is thus very considerable in each case.

The present invention is concerned with the task to so further develop a control system of the aforementioned type of construction that a control of the idling rotational speed within narrower limits is achieved without temperature-dependent adjusting members and therewith with slight structural expenditures and low costs also in case of strongly changing operating temperatures and loads of the internal combustion engine.

The underlying problems are solved according to the present invention in that the opening cross section of the by-pass control valve increases progressively. Owing to this construction of the by-pass valve, the idling rotational speed is kept far-reachingly constant also with changing operating temperatures and loads without additionally requiring, for example, costly temperature-dependent warm-up controllers. Even during the cold start, the control installation according to the present invention controls the idling speed within narrow rotational speed limits, whereby only a fuel enrichment of conventional type is necessary. It is achieved by the progressively increasing opening cross section in the by-pass valve that slight suction pipe pressure differences, i.e., small rotational speed differences, lead with a relatively high power requirement to larger changes of the opening cross section and therewith filling changes than with a relatively small power requirement.

The control installation according to the present invention is advantageously applicable both to injection internal combustion engines having applied ignition, especially with a fuel admixture controlled in dependence on the air quantities, as also to carburetor internal combustion engines, whereby the most advantageous application results with an injection controlled in dependence on the air quantity due to the consideration of the by-pass air in the air quantity measuring device.

Accordingly, it is an object of the present invention to provide a control installation for the idling rotational speed of internal combustion engines which avoids by simple means the aforementioned shortcomings and drawbacks encountered in the prior art.

Another object of the present invention resides in a control installation for the idling rotational speed of internal combustion engines in which a completely satisfactory control of the idling rotational speed can be attained under all operating conditions.

A further object of the present invention resides in a control system for the idling rotational speed of internal combustion engines, by means of which the idling rotational speed of the engine can be kept within relatively narrow limits both during cold start and during operation at normal engine temperature with or without the engagement of additional and/or auxiliary aggregates and even with automatic transmissions.

Still another object of the present invention resides in a control installation for the idling rotational speed of internal combustion engines which is simple in construction, involves relatively few parts and is highly effective for its intended purposes.

Another object of the present invention resides in an idling speed control installation for internal combustion engines which is not only relatively simple in structure but also relatively inexpensive in manufacture and installation.

These and other objects, features and advantages of the present invention will become more apparent from the following description when taken in connection with the accompanying drawing which shows, for purposes of illustration only, several embodiments in accordance with the present invention, and wherein.

Figure 1:
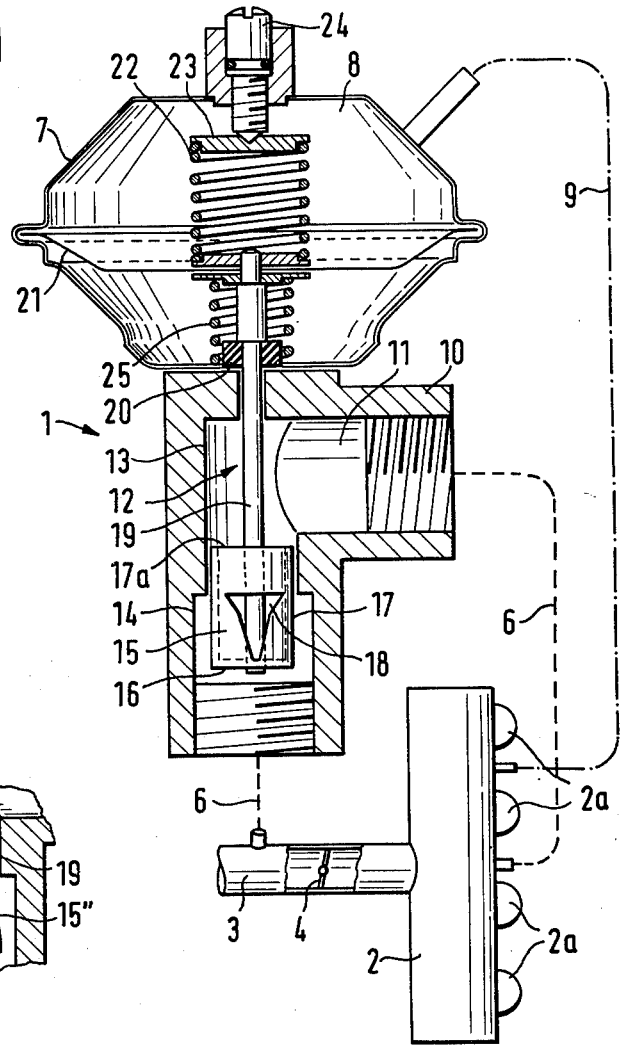
FIG. 1 is a somewhat schematic view, partly in cross section, of a control installation for the idling rotational speed of internal combustion engines in accordance with the present invention.

Referring now to the drawing wherein like reference numerals are used throughout the various views to designate like parts, and more particularly to FIG. 1, a by-pass control valve generally designated by reference numeral 1 is illustrated in this figure with its connections to a suction manifold 2 having tuned pipes 2*a* and to the suction pipe 3 with the throttle valve 4. The by-pass control valve 1 is disposed in a by-pass line 6 which is connected with the suction pipe 3 upstream of the throttle valve 4 and which terminates downstream of the throttle valve 4 in the suction manifold 2. The by-pass control valve 1 includes a diaphragm box 7 whose chamber 8 is adapted to be acted upon by the suction pipe pressure by way of a line 9, and a housing 10. The housing 10 is provided with a bore 11 and at right angle thereto with a stepped bore 12 having a narrower part 13 and a widened part 14. A cup-shaped valve member 15 is displaceably guided in the narrower part 13 of the stepped bore 12, whose bottom 16 faces the widened part 14. A cylindrical casing 17 adjoins the bottom 16 of the valve member 15, which is provided with two mutually opposite openings 18. The openings 18 increase in their width progressively from the bottom 16. The axial extent of the openings 18 in the casing 17 corresponds essentially to the stroke of the valve member 15 in the housing 10.

An actuating rod 19 is secured to the bottom 16 of the valve member 15, which projects through a seal 20 out of the housing 10 into the diaphragm box 7. The other end of the actuating rod 19 is secured to the diaphragm 21 in the diaphragm box 7. The actuating rod 19 and the end face of the seal 20 form a limit abutment for the stroke of the valve body 15. A compression spring 22 is arranged in the chamber 8 of the diaphragm box 7 which is adapted to be adjustable in its prestress under interposition of a disk 23 by means of an idling regulating screw 24. A counterspring 25 is arranged on the side of the diaphragm 21 opposite the chamber 8 which serves for matching the characteristics of the spring 22.

Figure 2:
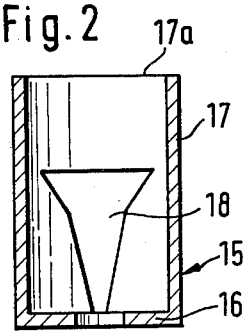
FIG. 2 is a center longitudinal cross-sectional view, on an enlarged scale, through the valve body of the by-pass control valve illustrated in FIG. 1 in accordance with the present invention.

FIG. 2 illustrates on an enlarged scale how the opening 18 becomes progressively wider stepped in the direction toward the edge 17*a* and starting from the bottom 16 thereof.

Figure 3:
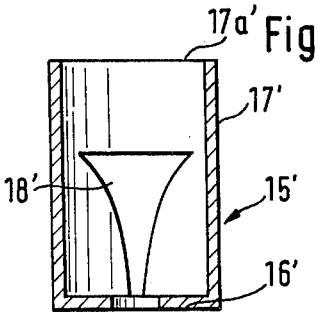
FIG. 3 is a center longitudinal cross-sectional view, similar to FIG. 2, through a modified embodiment of a valve body according to the present invention.

An opening 18 in the valve body 15' which becomes progressively wider in a continuous manner, is illustrated in FIG. 3.

During the starting and the following warm-up of the internal combustion engine, a suction pipe pressure results in the suction manifold 2 which is the lower in values, the higher the rotational speed of the internal combustion engine rises with a closed throttle valve 4. The suction pipe pressure effects by means of the diaphragm 21 in the diaphragm box 7 an adjustment of the valve body 16 of the by-pass valve 1 to a position adapted to be determined by the idling control screw 24. Depending on the load as well as on the outside, respectively operating temperature of the internal combustion engine, the by-pass control valve 1 is thereby opened more or less far. By reason of the higher output requirement and therewith also filling requirement, the by-pass control valve 1 operates with a cold engine and with additionally engaged additional and auxiliary aggregates within a range, in which a given stroke of the valve member 15 causes relatively large changes of the control section. With a warm internal combustion engine and without additionally engaged additional and auxiliary aggregates, the by-pass control valve 1 operates within a range, in which an equal stroke of the valve member 15 causes relatively small changes of the control cross section. In this manner, the by-pass control valve according to the present invention can control all load ranges occurring during idling within small control strokes and therewith within small changes of the suction pipe pressure effective in the diaphragm box 7 and therewith also within slight idling rotational speed changes.

If an additional aggregate, for example, an automatic transmission with hydraulic coupling or torque converter, an air-conditioning compressor, a hydraulic servo-pump and the like is turned on, then the idling rotational speed of the internal combustion engine drops only very slightly, for already a suction pipe pressure in the suction manifold 2 which is increased only slightly thereby, produces a further opening of the by-pass control valve 1 which is adequate therefor. This further opening is thereby the larger, the greater the over-all load of the internal combustion engine since a progressively increasing opening tendency is coordinated at the opening 18 to an increasing suction pipe pressure. The larger air quantity which flows through the opening 18 effects, for example, in conjunction with an injection system controlled in dependence on the air quantity, directly an increased injected fuel quantity so that the fuel/air ratio is thereby correctly controlled without further structural expenditure in every position of the by-pass control valve 1. With a release of the load as a result of turning off of additional aggregates or also as a result of reaching the normal operating temperature of the internal combustion engine, the by-pass valve 1 closes with a slightly increasing rotational speed and as a result thereof with a decreasing suction pipe pressure, whereby in the range of the opening 18 coordinated to the smallest load, i.e., when the internal combustion engine operates at its normal operating temperature without load by additional aggregates, relatively small cross-sectional changes are produced by relatively large valve strokes, corresponding to relatively large rotational speed changes by relatively small filling changes of the engine.

By matching the cross section of the opening 18, the size of the diaphragm 21 and the characteristics of the springs 22 and 25 to the idling behavior of the internal combustion engine as well as possibly also to the creeping tendency of an automatic transmission, a construction and design of the by-pass valve 1 can be determined which fully satisfies all load possibilities of the internal combustion engine during idling with a relatively slight rotational speed difference and with a quiet running thereof inclusive low creeping tendency of a motor vehicle with an automatic transmission.

Figure 4:
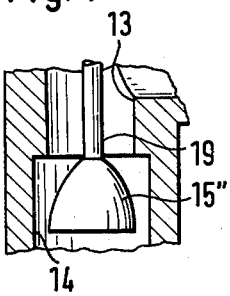
FIG. 4 is a cross-sectional view through the seat area of the by-pass control valve with a further modified embodiment of the valve body in accordance with the present invention.

For matching the cross section of the opening 18 according to FIGS. 1 and 2, an opening cross section can be selected which is composed of two trapezoidal-like surfaces placed directly adjacent one another, whereby within the range which is coordinated to lower loads during idling, a relatively flat characteristic and within the range which is coordinated to the higher loads, a relatively steep characteristic with a bend-shaped transition results. With a construction according to FIG. 3 having a continuous arcuately shaped boundary of the cross section of the opening 18', a transition bend is obviated, whence a more continuous control can be attained. The construction according to FIG. 4 involves exclusively a kinematic reversal of the valve shape whereby the valve body 15" produces by its outer axially symmetrical form a similar transitionless characteristic, as is attainable in FIG. 3 by the form of the opening 18'. However, also other known types of valves can be used for achieving such a progressive characteristic of the opening cross section.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A control installation for the idling rotational speed of internal combustion engines, comprising a by-pass control valve means disposed in parallel to a selectively actuatable throttle valve means and controlled by an adjusting means dependent on the suction pipe pressure, the opening cross section of the by-pass control valve means increasing with increasing suction pipe pressure, characterized in that the rate of increase of the opening cross section of the by-pass control valve means with increasing suction pipe pressure is progressive.

2. A control installation according to claim 1, characterized in that the rate of increase of the opening cross section increases progressively in at least two steps.

3. A control installation according to claim 1, characterized in that the rate of increase of the opening cross section increases progressively continuously.

4. A control installation according to claim 1, characterized in that the by-pass control valve means includes a substantially cylindrical cup-shaped valve member which is displaceably guided in a narrower part of a stepped bore, in that at least one opening is provided in the casing of the cup-shaped valve member which progressively increases in width in the direction from the bottom to the edge of the cup-shaped valve member, in that the bottom of the valve member faces the wider part of the stepped bore and in that the opening of the valve member is located in the enlarged part of the bore in the normal position of the valve member coordinated to the highest suction pipe pressure.

5. A control installation according to claim 4, characterized in that the opening width increases progressively in at least two steps.

6. A control installation according to claim 4, characterized in that the opening width increases progressively continuously.

7. A control installation according to claim 1, characterized in that the opening cross section is produced by a valve body having an external configuration producing the progressive rate of increase of the opening cross section with increasing suction pipe pressure.

8. A control installation according to claim 7, characterized in that the valve body has an approximately bell-shaped external configuration cooperating with a fixed valve seat.

9. A control installation according to claim 1, characterized in that said adjusting means dependent on the suction pipe pressure for controlling the by-pass control valve means includes a diaphragm operably connected to said by-pass control valve means and first and second spring means cooperating with said diaphragm on opposed sides thereof, the characteristic of the spring means being adjusted with respect to the operating characteristics of the engine during idling under all load possibilities.

* * * * *